United States Patent [19]

Aihara et al.

[11] 4,389,624

[45] Jun. 21, 1983

[54] DIELECTRIC-LOADED COAXIAL RESONATOR WITH A METAL PLATE FOR WIDE FREQUENCY ADJUSTMENTS

[75] Inventors: Yukichi Aihara, Kawasaki; Sadahiko Yamashita, Sagamihara, both of Japan

[73] Assignee: Matsushita Electric Industrial Company, Limited, Osaka, Japan

[21] Appl. No.: 251,967

[22] Filed: Apr. 3, 1981

[30] Foreign Application Priority Data

Apr. 4, 1980 [JP] Japan ..... 55-44885

[51] Int. Cl.[3] ..... H01P 7/04

[52] U.S. Cl. ..... 333/226; 333/207

[58] Field of Search ..... 333/202, 206, 207, 232, 333/235, 245, 226; 334/41–45

[56] References Cited

U.S. PATENT DOCUMENTS 2,085,223 6/1937 Kolster ..... 333/235 X 2,645,679 7/1953 Reade ..... 333/202 X

*Primary Examiner*—Marvin L. Nussbaum

*Attorney, Agent, or Firm*—Lowe, King, Price & Becker

[57] ABSTRACT

A coaxial resonator comprising an outer conductor with closed and open ends, an inner conductor concentrically disposed in the outer conductor to establish a short circuit at the closed end and an open circuit at the open end, and a dielectric member mounted in the open circuit between the outer and inner conductors. An electrode is connected to the open circuit end of the inner conductor with a spacing from the dielectric member. A conductive plate, having a smaller surface area than that of the electrode but larger than the transverse cross-sectional area of the inner conductor, is provided between the dielectric member and the electrode. The dimensions of the conductive plate is appropriately chosen to accommodate frequency variations which might occur as a result of a connection with an external circuit.

6 Claims, 7 Drawing Figures

DIELECTRIC-LOADED COAXIAL RESONATOR WITH A METAL PLATE FOR WIDE FREQUENCY ADJUSTMENTS

BACKGROUND OF THE INVENTION

The present invention relates to a coaxial resonator of the type having an outer and inner conductor with the latter being concentrically disposed in the former in a short circuit relationship at one end thereof and in an open circuit relationship at the other end thereof wherein a dielectric member is disposed in the open circuit between the outer and inner conductors. The invention is useful for making a bandpass filter with a plurality of such coaxial resonators without altering the principal structure thereof.

Conventional quarter-wavelength coaxial resonators comprise an outer conductor having a closed end and an open end, and an inner conductor concentrically extending from the closed end of the outer conductor to the open end thereof. For purposes of making the coaxial resonator compact and making it have a high Q value, a dielectric member is provided in the open circuit between the outer and inner conductors. For frequency adjustment an electrode is connected to the open circuit end of the inner conductor in opposed relationship with a second electrode adjustably secured to a conductive housing. However, when the resonator is coupled to an external circuit the resonant frequency of the resonator tends to vary significantly depending on the coupling coefficient to such a degree that the frequency adjustment by the pair of electrodes is unable to compensate for such variation to obtain a desired value for the resonant frequency. This required the use of coaxial resonators which are tailored to meet the specific requirements of particular external circuits.

SUMMARY OF THE INVENTION

Accordingly, the primary object of the invention is to provide a quarter-wavelength coaxial resonator which is capable of accommodating frequency variations which might occur when the resonator is coupled to an external circuit.

The quarter-wavelength coaxial resonator of a concentrical structure comprises an outer conductor having closed and open ends, an inner conductor concentrically extending from the closed end to the open end of the outer conductor to establish a short circuit and an open circuit therewith. A dielectric member is provided in the open circuit between the outer and inner conductors. A first electrode is connected to the open circuit end of the inner conductor at a small distance from the dielectric member. A second electrode is adjustably mounted on the wall of a housing in which the outer conductor may be supported to form a capacitive coupling between the two electrodes. According to the invention, a conductive plate is provided in the space between the dielectric member and the first electrode, the surface area of the conductive plate being smaller than that of the first electrode but larger than the transverse cross-sectional area of the inner conductor. By appropriately selecting the thickness and surface area of the conductive plate, the resonant frequency of the resonator can be controlled in a range much greater than the range variable with by adjustment of the electrodes, whereby the coaxial resonator of the invention is capable of accommodating frequency variations which might be encountered when it is coupled to an external circuit without altering its structure. The invention is particularly useful for fabricating a bandpass filter with a plurality of such coaxial resonators in that the resonant frequency of each resonator tends to deviate significantly from the designed value.

BRIEF DESCRIPTION OF THE DRAWINGS

The invention will be further described with reference to the accompanying drawings, in which.

DETAILED DESCRIPTION

Figure 1:
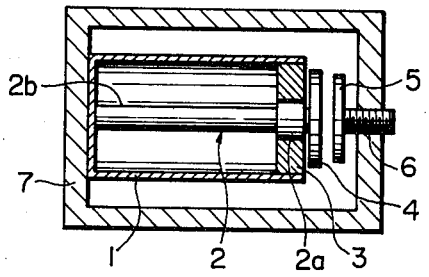
FIG. 1 PRIOR ART
FIG. 1 is an illustration of a prior art quarter-wavelength coaxial resonator.
Figure 2:
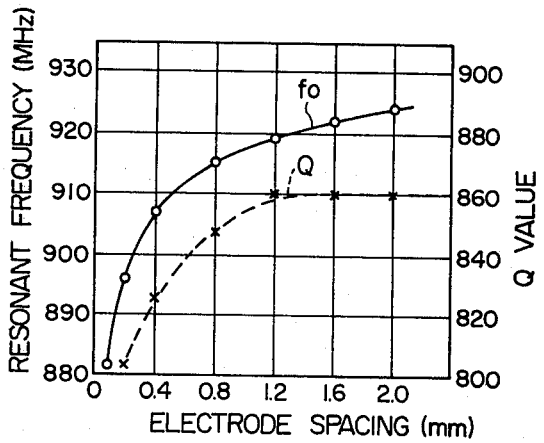
FIG. 2 PRIOR ART
FIGS. 2 and 3 are graphic illustrations of the operating characteristics of the coaxial resonator of FIG. 1.
Figure 3:
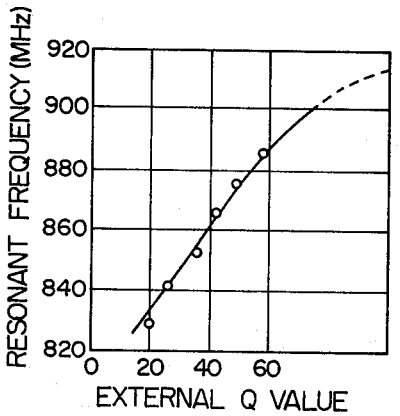
FIG. 3 PRIOR ART

Before describing the present invention, reference is first had to FIGS. 1 to 3 in which a prior art coaxial resonator and its operating characteristics are illustrated. The prior art resonator comprises an outer conductor 1 of a cylindrical structure having a closed end and an open end. An inner conductor 2 is concentrically supported in the outer conductor 1 and establishes a short circuit therewith at its closed end and an open circuit therewith at its open end. The inner conductor 2 is of a stepped, cylindrical structure having a larger diameter section 2*a* and a smaller diameter section 2*b* having a greater length than the larger diameter section 2*a*. Between the open circuit ends of the outer conductor 1 and the inner conductor 2 is an annular member 3 of a dielectric material. A first electrode 4 is connected to the open circuit end of the inner conductor 2 adjacent to the larger diameter section 2*a* at a small distance from the dielectric member 3. A second electrode 5 is adjustably mounted by a screw 6 to an end wall of a conductive housing 7 in opposed relation with the first electrode 4 to form a capacitive coupling between them. The resonant frequency of the coaxial resonator is controlled by varying the spacing between the first and second electrodes. FIG. 2 is an illustration of the resonant frequency $f_o$ and the unloaded Q value of the prior art coaxial resonator as a function of the electrode spacing. As a function of variations in electrode spacing from zero to 2.0 millimeters, the resonance frequency varies as much as 40 MHz, while the unloaded Q value tends to decrease significantly when the electrode spacing has a small value. Therefore, a practical value of the electrode spacing is greater than 0.8 millimeters which in turn places limitations on the variable range of resonance frequencies to as small as 10 MHz. The resonant frequency $f_o$ is also a function of the amount of coupling with an external circuit. As illustrated in FIGS. 3 the resonant frequency experiences a variation of as much as 100 MHz as a function of the coupling with the external circuit when the electrode spacing is adjusted to 0.8 millimeters, for example.

It is known that when a plurality of coaxial resonators is cascaded to constitute a filter circuit, the coupling coefficient of the filter with input and output circuits tends to be 10 times greater than the coefficient of the interstage coupling. Therefore, if coaxial resonators are constructed to have equal dimensions and shapes, the individual resonant frequencies tend to deviate as much as several tens of MHz from the intended values. It is thus impossible with the prior art coaxial resonators to adjust their resonant frequencies by varying their electrode spacings. This required that individual coaxial resonators be constructed to have different dimensions from each other to individually adjust their resonant frequencies to tight tolerances. This results in a loss of freedom in designing a wide variety of filters. Furthermore, since the prior art coaxial filter has a poor Q value for small electrode spacings, it is difficult to design an ideal filter on a plurality of such resonators with the individual resonant frequencies deviating slightly from the center frequency of the passband of the filter by resorting only to adjustment of the electrode spacings.

Figure 4:
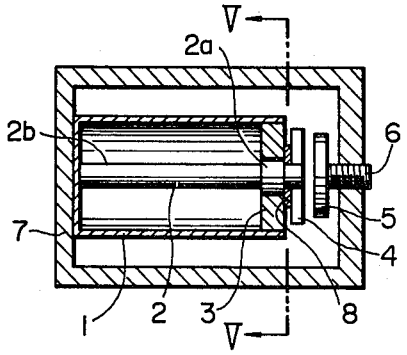
FIG. 4 is an illustration of a quarter-wavelength coaxial resonator of the invention.
Figure 5:
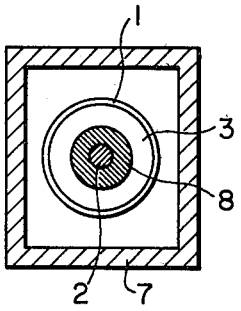
FIG. 5 is an illustration of a cross-sectional view taken along the lines 5—5 of FIG. 4.
Figure 6:
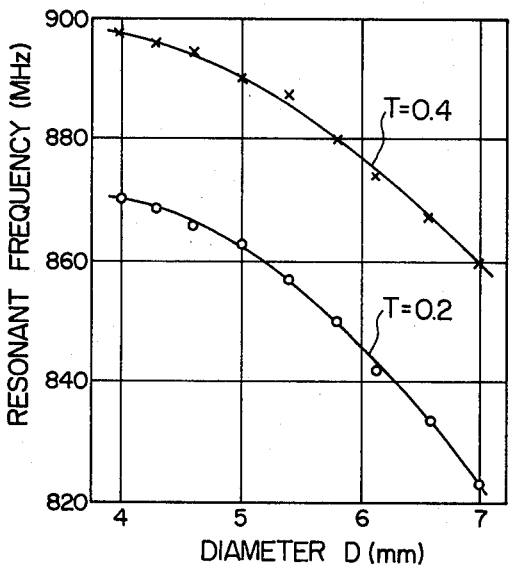
FIG. 6 is a graphic illustration of operating characteristics of the coaxial resonator of the invention.

An embodiment of the present invention is illustrated in FIG. 4 in which parts corresponding to those in FIG. 1 are marked with the same numerals as those in FIG. 1. The resonator of the invention is generally similar to the prior art resonator of FIG. 1 with the exception that a conductive annular plate 8 is disposed in the space between the dielectric member 3 and the electrode 4. The diameter of the conductive member 8 is larger than that of the larger diameter section *2a* of the inner conductor 2 but smaller than the diameter of the electrode 4. The conductive member 8 has a center opening engaged with the end portion of the inner conductor 2 so that it can be easily dismantled for replacement. A high Q value can be obtained by making the conductive member 8 with copper- or silver-plated material as other components of the resonator. A desired value is obtained for the resonant frequency by appropriately dimensioning the surface area and the thickness of the conductive member 8. In this embodiment, the inner and outer conductors are formed of cylindrical members as shown in FIG. 5. The resonator of the invention is not limited to the circular cross-section, but applicable to any cross-section configuration. FIG. 6 is a graphic illustration of the resonant frequency of the resonator of the invention as a function of the diameter "D" of the conductive member 8 with its thickness "T" as a parameter. As illustrated, the resonant frequency varies as much as 30 MHz for a diameter D in a range from 4.0 mm to 6.5 mm with a thickness T of 0.4 mm and it further varies as much as 50 MHz for a diameter 4.0 mm to 7.0 mm with a thickness of 0.2 mm. Therefore, by using an appropriately dimensioned conductive member 8 it is possible to obtain a desired resonant frequency in a range as much as 80 MHz without altering the principal parts of the coaxial resonator. The thickness of the conductive member 8 may be selected to have a value other than the values as noted above without reducing the Q value provided that the conductive member 8 makes an intimate contact with the inner conductor 2 and with the electrode 4. Therefore, it is seen that coaxial resonators of the same construction can be connected to any external circuit by using a conductive member 8 which is so dimensioned as to compensate for a large amount of deviation of its resonant frequency which would occur as a result of its coupling with the external circuit.

Figure 7:
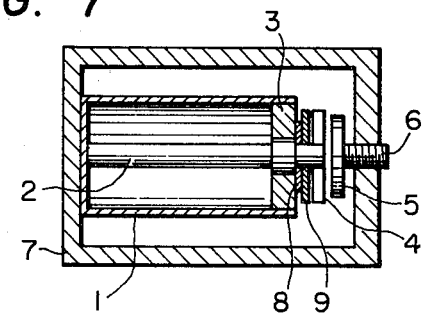
FIG. 7 is an illustration of a modified form of the embodiment of FIG. 4.

Another embodiment of the invention is illustrated in FIG. 7 which is similar to the embodiment of FIG. 4 with the exception that it further includes a coupling member 9 disposed between the conductive member 8 and the electrode 4. The coupling member 9 is formed of an insulative material such as the one known under the trademark "Teflon". On opposite surfaces of the insulative material is deposited a copper foil of a predetermined pattern to provide an impedance-matched coupling with an external circuit. The conductive member 8 serves to provide a low impedance connection between the coupling member 9 and the inner conductor 2 to assure a high Q value.

Assuming that a TChebyshev type bandpass filter of the 800 MHz range with a passband of 30 MHz is constructed by using six coaxial resonators of FIG. 4. The external Q value of the resonators with external circuits are assumed to be 25 and the interstage coupling coefficient is assumed to be 0.02. From FIG. 3, the resonant frequency of the resonators which are directly coupled with the external circuits is approximately 840 MHz. The resonant frequency of the intermediate stages is about 875 MHz, so that there is a difference of 35 MHz between them. Use of conductive members 8 with a thickness of 0.2 mm and a diameter of 5.4 mm for the resonators directly coupled with the external circuits and those with a thickness of 0.2 mm and a diameter of 7.0 mm for the intermediate stages enables compensation of the 35 MHz frequency difference without altering the structure of each resonator.

What is claimed is:

1. A coaxial resonator comprising, an outer conductor having a closed end and an open end, an inner conductor extending concentrically in said outer conductor and connected therewith in a short circuit at said closed end and in an open circuit at said open end, a dielectric member disposed in said open circuit between said outer and inner conductors, a first conductive plate connected to the open circuit end of said inner conductor and having a larger surface area than the transverse cross-sectional area of said inner conductor, and a second conductive plate having a smaller surface area than the surface area of said first conductive plate and disposed between said dielectric member and said first conductive plate while making contact with said inner conductor.

2. A coaxial resonator as claimed in claim 1, further comprising a third conductive plate disposed between said first and second conductive plates for providing an impedance matched connection to an external circuit.

3. A resonator as claimed in claim 1 or 2, wherein said second conductive plate has a larger surface area than the transverse cross-sectional area of said inner conductor.

4. A coaxial resonator as claimed in claim 1 or 2, further comprising a conductive housing in which said outer conductor is supported at one end thereof and a fourth conductive plate adjustably secured to said housing with respect to said first conductive plate to form a capacitive coupling therebetween.

5. A method for adjusting the resonant frequency of a coaxial resonator, said coaxial resonator having an outer conductor with closed and open ends, an inner conductor extending concentrically in said outer conductor and connected therewith in a short circuit at said closed end and in an open circuit at said open end, a dielectric member disposed in said open circuit between said outer and inner conductors, and a first conductive plate connected to the open circuit end of said inner conductor and having a larger surface area than the transverse cross-sectional area of said inner conductor, said method comprising providing a second conductive plate between said dielectric member and said first conductive plate while making contact with said inner conductor, said second conductive plate having a surface area smaller than the surface area of said first conductive plate.

6. A method as claimed in claim 5, wherein the surface area of said second conductive plate is larger than the transverse cross-sectional area of said inner conductor.

* * * * *